US005594211A

United States Patent [19]

Di Troia et al.

[11] Patent Number: 5,594,211

[45] Date of Patent: Jan. 14, 1997

[54] ELECTRICAL SOLDER SPLICE CONNECTOR

[75] Inventors: Gary W. Di Troia, Nashua; Richard E. Robicheau, Amherst, both of N.H.

[73] Assignee: Burndy Corporation, Norwalk, Conn.

[21] Appl. No.: 392,373

[22] Filed: Feb. 22, 1995

[51] Int. Cl.[6] ..... H01R 4/02

[52] U.S. Cl. ..... 174/84 R; 174/88 R; 174/94 R

[58] Field of Search ..... 174/84 R, 88 R, 174/94 R; 439/874, 910; 228/132; 285/287; 29/748, 869, 874

[56] References Cited

U.S. PATENT DOCUMENTS

| | | | |
|---|---|---|---|
| 296,074 | 4/1884 | Shaw . | |
| 1,951,654 | 3/1934 | Green . | |
| 2,504,512 | 4/1950 | Esslie . | |
| 3,296,577 | 1/1967 | Travis et al. | 339/275 |
| 3,665,367 | 5/1972 | Kelier et al. | 339/275 T |
| 3,837,688 | 9/1974 | Vollbehr | 285/177 |
| 3,852,517 | 12/1974 | Fava | 174/84 R |
| 4,209,895 | 7/1980 | Powell | 29/874 |
| 4,317,277 | 3/1982 | Bennett et al. | 29/860 |
| 5,195,910 | 3/1993 | Enomoto et al. | 439/578 |

OTHER PUBLICATIONS

Split Solder Splice Drawing No: SA208382, Burndy Corporation, 1 pa 1993.

*Primary Examiner*—Kristine L. Kincaid
*Assistant Examiner*—Marc D. Machtinger
*Attorney, Agent, or Firm*—Perman & Green

[57] ABSTRACT

A split solder sleeve is provided with a conductor channel extending between open opposite ends of the sleeve and a longitudinal slot extending through the side wall of the sleeve into the channel and between the ends of the sleeve. The improvement includes a hole extending through the side wall of the sleeve into the conductor channel. The hole allows solder to be poured into the sleeve and around the conductors directly on the ends of the conductors. The hole allows greater visual inspection of the spliced solder joint both during and after pouring of the solder.

8 Claims, 1 Drawing Sheet

ELECTRICAL SOLDER SPLICE CONNECTOR

BACKGROUND OF THE INVENTION

1. Field of the Invention

The present invention relates to electrical connectors and, more particularly, to a solder splice connector.

2. Prior Art

Electrical solder splice connectors have been around for many years as can be seen in U.S. Pat. No. 296,074. Other types of solder connections and connectors can be seen in the following U.S. Patents:

| | |
|---|---|
| 2,504,512 | 3,296,577 |
| 3,665,367 | 3,837,688 |
| 4,209,895 | 5,195,910 |

SUMMARY OF THE INVENTION

In accordance with one embodiment of the present invention, in a solder sleeve having a conductor channel extending between opposite ends of the sleeve, and a first longitudinal slot extending through a sidewall of the sleeve into the channel and extending between the opposite ends of the sleeve, the improvement comprises a hole extending through the sidewall of the sleeve into the conductor channel.

In accordance with another embodiment of the present invention, an electrical conductor solder sleeve is provided comprising a housing and means for accessing a conductor channel in the housing. The housing has a conductor channel extending between opposite ends of the sleeve and a first slot extending between the ends through a sidewall of the sleeve. The means for accessing is for accessing ends of conductors when positioned in the conductor channel. The means for accessing includes a hole separate from the slot that extends through the sidewall of the sleeve.

In accordance with another embodiment of the present invention, an electrical conductor solder sleeve is provided comprising a housing and means for pouring solder into the housing. The housing has a conductor channel extending between open opposite ends of the sleeve and a first slot extending between the ends through a sidewall of the housing. The means for pouring solder into the housing is for pouring solder into the conductor channel. The means for pouring is separate from the slot and the open opposite ends of the housing.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
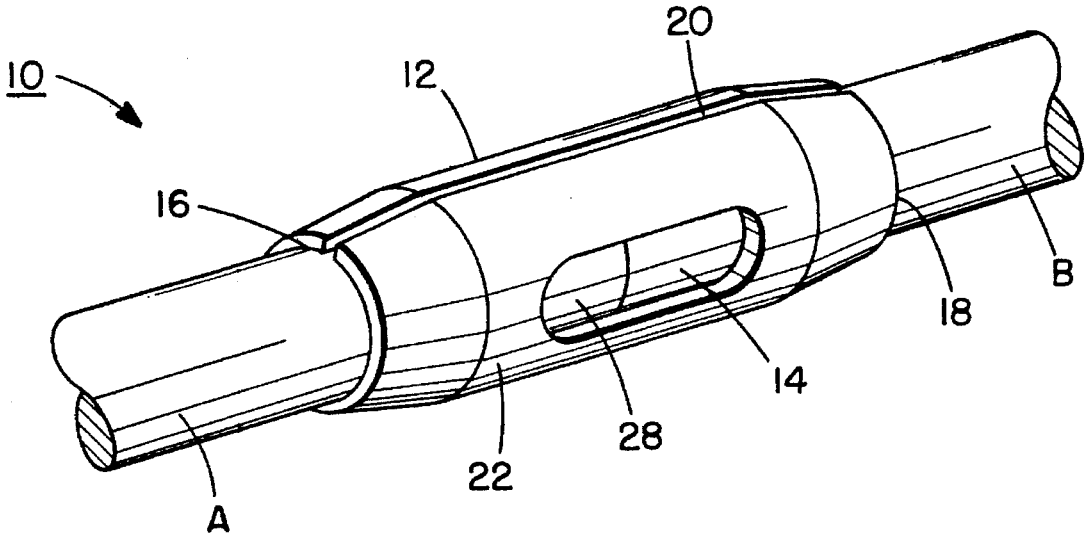
FIG. 1 is a perspective view of an electrical solder splice connector incorporating features of the present invention with two electrical conductors located therein.

Referring to FIG. 1, there is shown a perspective view of an electrical solder splice connector 10 incorporating features of the present invention. Although the present invention will be described with reference to the single embodiment shown in the drawings, it should be understood that the present invention can be incorporated into different types of embodiments. In addition, any suitable size, shape or type of elements or materials could be used.

Figure 2:
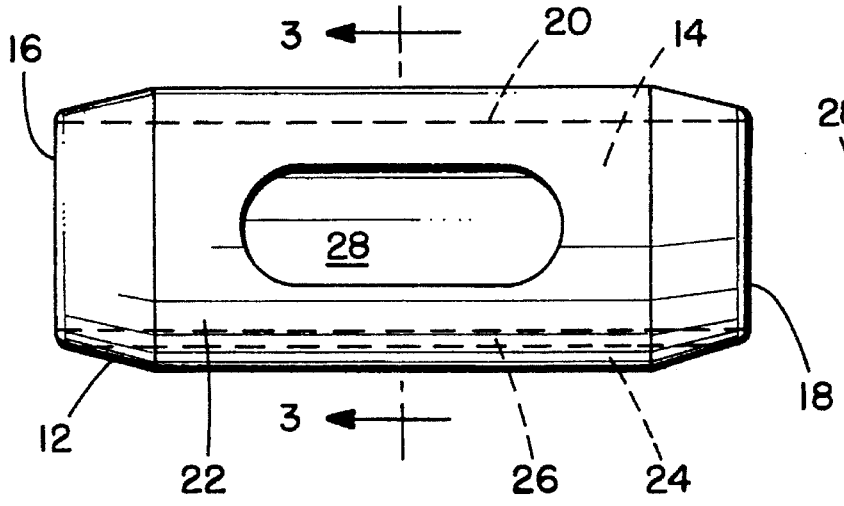
FIG. 2 is an elevational side view of the connector shown in FIG. 1.
Figure 3:
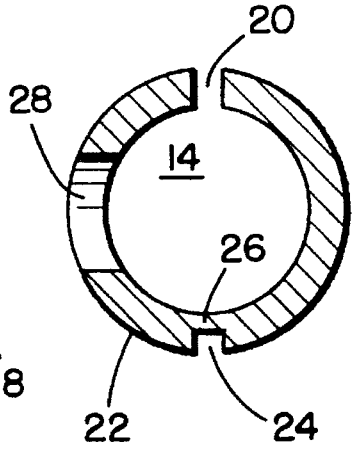
FIG. 3 is a cross sectional view of the connector shown in FIG. 2 taken along line 3—3.

The connector 10 is comprised of a solder sleeve or housing 12 and solder (not shown) that is poured into the sleeve 12. The sleeve 12 is preferably a one-piece member made of metal. The sleeve 12 has a general tube shape with a center conductor channel 14 and two opposite open ends 16, 18. Referring also to FIGS. 2 and 3, the sleeve 12 includes a first elongate longitudinal slot 20 along its side wall 22. The slot 20 extends entirely through the side wall 22 into the conductor channel 14. The slot 20 extends the entire length of the sleeve 12 between the two ends 16, 18. In alternate embodiments, the first slot 20 could have any suitable type of shape. Located on the opposite side of the sleeve 12 is a second elongate longitudinal slot 24. The second slot 24, similar to the first slot 20, extends the entire length of the sleeve 12. However, the second slot 24 does not extend entirely through the sidewall 22. Thus, a thin area 26 is formed along the length of the sleeve 12 to function as a bending area. In alternate embodiments, the second slot 24 could have any suitable shape or, not be provided.

Located about 90° offset from the two slots 20, 24 is a hole 28. In the embodiment shown, the hole 28 has a general oval shape. In alternate embodiments, the hole 28 could have any suitable shape, size or location. More than one hole 28 could be provided. In the embodiment shown, the hole 28 is separate and apart from the slots 20, 24. However, in alternate embodiments, the hole 28 could be connected to the slots 20, 24. The hole 28 is relatively large with a width about five times larger than the width of the first slot 20 and a length preferably between about 60% to about 30% the length of the sleeve 12.

As noted above, split solder sleeves have existed for some time. The connector provides a means for holding two conductor ends together while molten solder is poured to complete the electrical and mechanical splice. The prior art connectors have suffered from a problem in that surface tension of molten solder prevents easy and uniform flow into the joint between the conductors. In addition, a lack of access to the joint prevented visual inspection of the final electrical connection. The sleeve 12 of the present invention is very similar to conventional split solder sleeves in that it has a split (the slot 20) along the tubular structure that allows the sleeve 12 to be closed or compressed onto the conductors A, B being spliced. The compression of the sleeve onto the conductors provides a mechanical holding function for when the solder is later poured. The improvement of the present invention is the provision or addition of the hole 28 in the side wall of the sleeve 12. The hole 28 allows for access to the conductors inside the connector. The opening provides a means to readily pour the solder into the connector through the hole 28 and around the conductors inside the sleeve. The access to the conductor ends produces a more complete and secure solder splice. In addition, the spliced solder joint is readily available for visual inspection.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical conductor solder sleeve comprising:

a housing having a conductor channel extending between opposite ends of the housing and a first slot extending between the ends through a side wall of the housing and a second slot, wherein the second slot does not extend entirely through the side wall; and means for accessing ends of conductors positioned in the conductor channel, the means for accessing including a hole, separate from the slot, that extends through the side wall of the housing.

2. A sleeve as in claim 1 wherein the hole has a general oval shape.

3. A sleeve as in claim 1 wherein the hole is offset about 90° from the slot.

4. A sleeve as in claim 1 wherein the second slot is offset from the first slot about 180°.

5. An electrical conductor solder sleeve comprising:

a housing having a conductor channel extending between open opposite ends of the sleeve and a first slot extending between the ends through a side wall of the housing and a second slot, wherein the second slot does not extend entirely through the side wall; and means, separate from the slot and the open opposite ends of the housing, for pouring solder into the conductor channel, wherein the means for pouring comprises a hole extending through the side wall of the housing.

6. A sleeve as in claim 5 wherein the hole is separate and spaced from the slot.

7. A sleeve as in claim 5 wherein the hole is offset about 90° from the slot.

8. A sleeve as in claim 5 wherein the second slot is offset from the first slot about 180°.

* * * * *